United States Patent [19]

Weitz

[11] Patent Number: 4,784,884

[45] Date of Patent: Nov. 15, 1988

[54] ARTIFICIAL PLANT AND METHOD OF MAKING SAME

[76] Inventor: Henry Weitz, Prosperity House, 8A Granville Road, Kowloon, Hong Kong

[21] Appl. No.: 115,414

[22] Filed: Nov. 2, 1987

[51] Int. Cl.[4] ..... A41G 1/00

[52] U.S. Cl. ..... 428/26; 156/61

[58] Field of Search ..... 428/24, 26, 17; 156/61

[56] References Cited

U.S. PATENT DOCUMENTS

| | | | |
|---|---|---|---|
| 3,137,610 | 6/1964 | Flynn | 428/26 |
| 4,215,163 | 7/1980 | Lee | 428/26 X |
| 4,363,837 | 12/1982 | Weitz | 428/26 |
| 4,585,677 | 4/1986 | Hwang et al. | 428/26 |

FOREIGN PATENT DOCUMENTS

| | | | |
|---|---|---|---|
| 588131 | 1/1959 | Italy | 428/26 |

*Primary Examiner*—Henry F. Epstein
*Attorney, Agent, or Firm*—Alvin Sinderbrand

[57] ABSTRACT

An artificial representation of a plant is formed of plant organ simulating members, such as, stem-and leaf simulating members, respectively having rod-like and tubular connecting portions molded of thermoplastic resin and being axially interengaged to provide joints for assembling together the respective plant organ simulating members, whereupon, a heated needle-shaped element is pressed end-wise against the tubular connecting portion of each joint with such heated element extending substantially in a radial direction in respect to the axis of the respective rod-like connecting portion so as to fuse the thermoplastic resin and thereby penetrate through the tubular connecting portion and at least partly into the respective rod-like connecting portion. When the heated element is withdrawn, there remains a hole extending through the tubular connecting portion and penetrating into the rod-like connecting portion with the fused resin from the hole in the tubular connecting portion collecting, at least in part, in the portion of the hole in the respective rod-like connecting portion for locking together the respective plant organ simulating members.

10 Claims, 2 Drawing Sheets

ARTIFICIAL PLANT AND METHOD OF MAKING SAME

BACKGROUND OF THE INVENTION

1. Field of the Invention

This invention relates generally to artificial plants and, more particularly, is directed to improvements in artificial representations or simulations of plants of the type comprised of stem-simulating members molded of plastic and terminating in numerous stem portions on which separately molded or formed flower or leaf-simulating members are mounted.

2. Description of the Prior Art

It is known to provide an artificial plant by assembling together numerous plant organ simulating members, such as, stem-simulating members molded of plastic and each having suitably configured, branching stem portions, and flower or leaf-simulating members which are separately formed and suitably connected to the branching stem portions at locations along the latter. In known artificial plants of the described character, at each location along a stem portion of the stem-defining member at which a flower or leaf-simulating member is to be mounted, there is provided a projecting rod-like connecting portion, and each flower or leaf-simulating member has a petiole-like part molded of plastic and terminating in a tubular connecting portion open at one end for axially receiving the respective rod-like connecting portion. Usually, each tubular connecting portion is merely dimensioned to be frictionally retained on the respective rod-like connecting portion so that the resulting joint is liable to be separated or disconnected when the respective flower or leaf-simulating member is tugged or pulled. In order to reduce the likelihood of the removal of a flower or leaf-simulating member from the stem-defining member by separation of the respective joint, it has been proposed to provide the rod-like connecting portion with a ridge extending therearound, while the respective tubular connecting portion is formed with a corresponding annular groove in its inner surface so that the annular ridge will snap into such groove upon the axial insertion of the rod-like connecting portion into the tubular connecting portion. However, when the rod-like connecting portion and the tubular connecting portion are relatively dimensioned to provide substantial frictional resistance to their separation, or to provide the interference fit for engagement of the annular ridge on the rod-like connecting portion in the annular groove within the tubular connecting portion, there is the danger that the tubular connecting portion will be over stressed and split axially during the assembling together of the plant organ simulating members.

OBJECTS AND SUMMARY OF THE INVENTION

Accordingly, it is an object of this invention to provide an artificial representation of a plant which can be easily assembled from various separately formed plant organ simulating members, and which avoids the above described disadvantages of the prior art.

More specifically, it is an object of this invention to provide an artificial representation of a plant by assembling together plant organ simulating members which are economically and reliably secured against separation from each other.

In accordance with an aspect of this invention, an artificial representation of a plant comprises plant organ simulating members, such as, a stem-simulating member and a leaf-simulating member, respectively having rod-like and tubular connecting portions molded of thermoplastic resin and being axially interengaged to provide joints for assembling together the respective plant organ simulating members, with each of the joints having a hole fused through the respective tubular-connecting portion and penetrating into the respective rod-like connecting portion interengaged therewith so that the thermoplastic resin removed from the tubular connecting portion in fusing the hole therethrough collects at least in part in the portion of the hole penetrating into the respective rod-like connecting portion for securely locking together the respective plant organ simulating members.

In a method according to this invention, the fused hole is provided by pressing a heated needle-shaped element end-wise against the tubular connecting portion of each joint with the needle-shaped element extending substantially in a radial direction in respect to the axis of the respective rod-like connecting portion so as to penetrate through the tubular connecting portion and at least partly into the respective rod-like connecting portion, whereupon, the heated needle-shaped element is withdrawn in the radial direction to permit the fused thermoplastic resin of the tubular connecting portion to flow, at least in part, into the hole penetrating the rod-like connecting portion where the fused resin cools and sets for preventing relative turning and axial displacements of the respective rod-like and tubular connecting portions of the joint.

The above, and other objects, features and advantages of the invention, will be apparent in the following detailed description of an illustrative embodiment thereof which is to be read in connection with the accompanying drawings in which corresponding parts are identified by the same reference numerals in the several views.

DESCRIPTION OF A PREFERRED EMBODIMENT

Figure 1:
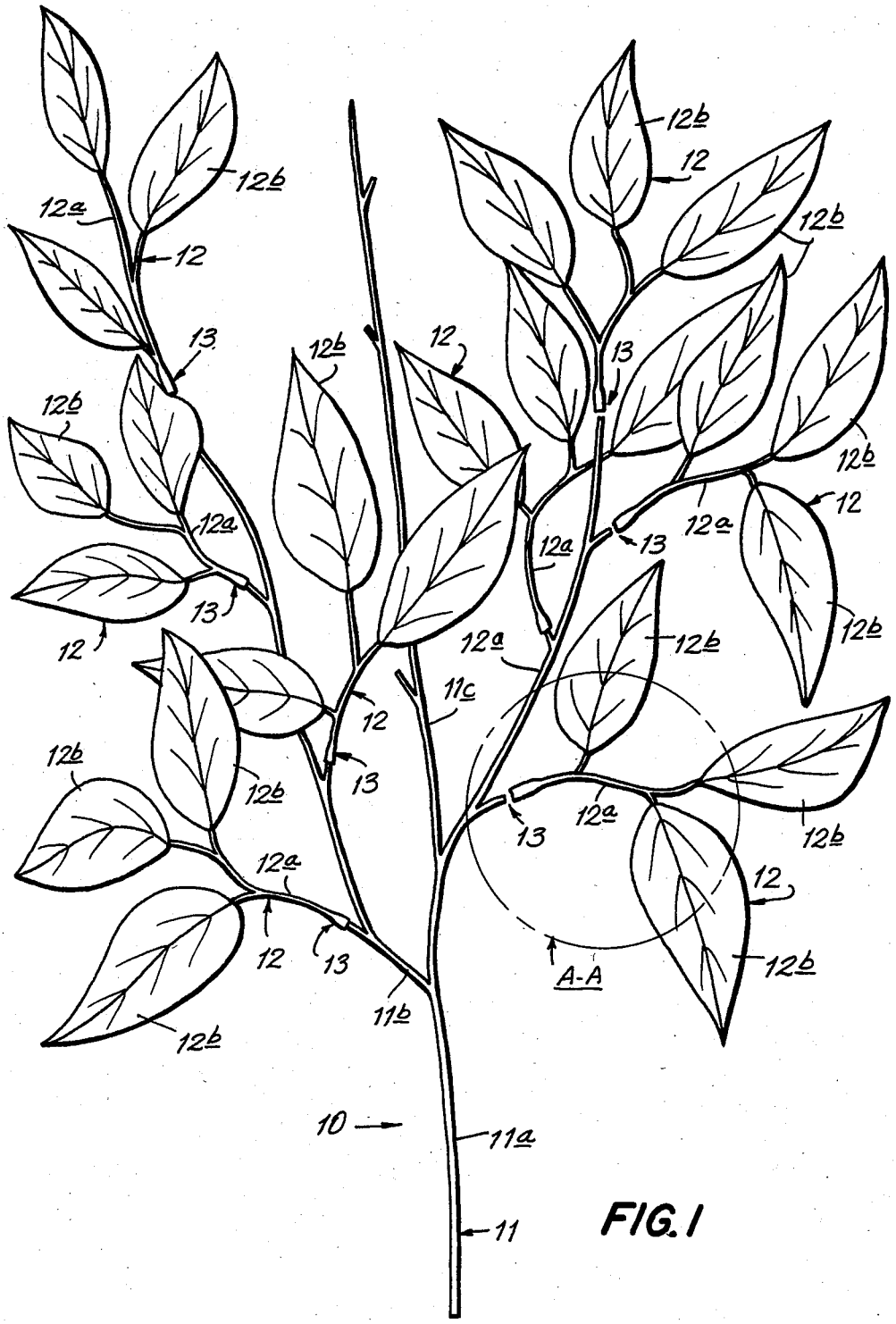
FIG. 1 is an elevational views showing an artificial representation of a plant to which the invention is desirably applied, and which is shown partly exploded and partly assembled.

Referring to the drawings in detail, and initially to FIG. 1 thereof, it will be seen that an artificial plant 10 according to one embodiment of the present invention generally comprises plant organ simulating members 11 and 12 which are separately formed, preferrably at least in part by molding of a thermoplastic resin, and then suitably assembled together at joints 13. More specifically, in the illustrated embodiment of the invention, the plant organ simulating member 11 constitutes a stem-simulating member suitably configured in its molding so as to define a main stem portion 11*a* and branching stem portions extending therefrom, as at 11*b*, 11*c* and 11*d*. Further, in the illustrated embodiment of the invention, each of the plant organ simulating members 12 is a leaf-simulating member including a stalk or petiole-like part 12*a* molded of thermoplastic resin and having a plurality of leaf-like parts 12*b* branching from the petiole-like part 12*a* and being desirably formed of a suitable fabric coated with the thermoplastic resin.

Figure 2:
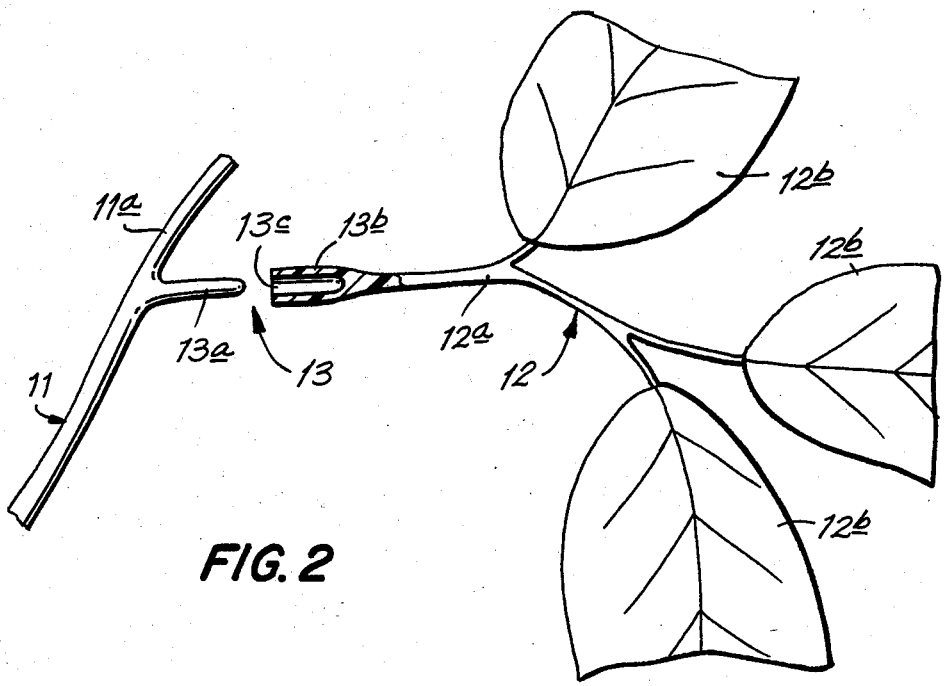
FIG. 2 is a fragmentary, detailed elevational view which is partly broken away and in section, and which specifically illustrates the portion of the structure appearing within the area of the dot-dash circular line A—A on FIG. 1.
Figure 3:
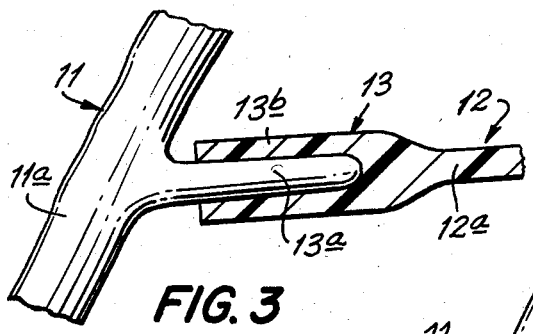
FIG. 3 is a further enlarged detailed sectional view specifically showing a rod-like connecting portion axially interengaged in a tubular connecting portion to form a joint for assembling together the plant organ simulating members.

Each of the joints 13 for assembling together the stem-simulating and leaf-simulating members 11 and 12 is shown to include a respective rod-like connecting portion 13*a* (FIG. 2) projecting from one of the branching stem portions 11*b*, 11*c* or 11*d* at a suitable location therealong and being integrally molded with the remainder of the stem-simulating member 11, and a respective tubular connecting portion 13*b* molded integrally with the petiole-like part 12*a* of thermoplastic resin as a terminal or end portion of such part 12*a*, and being open at one end, as at 13*c*. Each of the leaf-simulating members 12 is mounted on the stem-simulating member 11 by axially interengaging its tubular connecting portion 13*b* with the respective rod-like connecting portion 13*a*, as in FIG. 3.

After the rod-like connecting portion 13*a* and the tubular connecting portion 13*b* have been interengaged to form a joint 13, such joint is locked in accordance with the present invention so as to prevent relative turning and axial displacements of the respective rod-like and tubular connecting portions 13*a* and 13*b*. More specifically, as shown on FIG. 4, a needle-shaped element 14 which is electrically or otherwise heated is pressed end-wise against the tubular connecting portion 13*b* at a position intermediate the length of the latter with the needle-shaped element 14 extending substantially in a radial direction in respect to the axis of the respective rod-like connecting portion 13*a*. The heated needle-shaped element 14 fuses or melts the thermoplastic resin at the region of the contact of element 14 with tubular connecting portion 13*b* and then with rod-like connecting portion 13*a*. By reason of the pressing of the heated element 14 end-wise, for example, in the direction of the arrow 15 on FIG. 4, a hole 16 is fused or melted through the tubular connecting portion 13*b* and then at least partly into the respective rod-like connecting portion 13*a*. After penetration of the heated needle-shaped element 14 at least partly into rod-like connecting portion 13*a*, the heated needle-shaped element 14 is withdrawn in the radial direction, for example, in the direction indicated by the arrow 17 on FIG. 5, to permit the fused thermoplastic resin of the tubular connecting portion 13*b* to flow, at least in part, into the portion of the hole 16 penetrating the rod-like connecting portion 13*a* where the fused resin cools and sets, as at 18 on FIG. 5, for preventing relative turning and axial displacements of the rod-like and tubular connecting portions of the joint 13.

Figure 4:
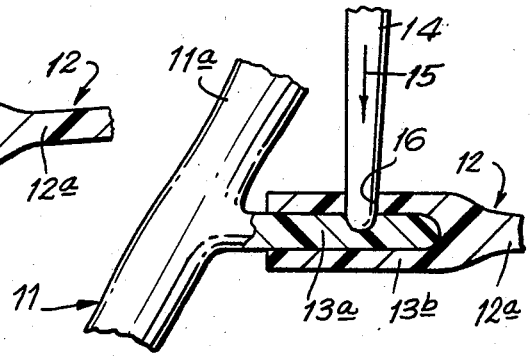
FIG. 4 is a sectional view similar to that of FIG. 3, but illustrating a step in the locking together of the interengaged rod-like and tubular connecting portions by a method according to an embodiment of the present invention.
Figure 5:
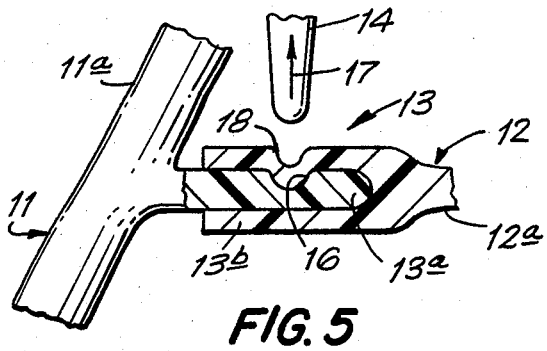
FIG. 5 is a sectional view similar to that of FIG. 4, but illustrating the locking together of the rod-like and tubular connecting portions at the completion of the method according to this invention.

Preferrably, as shown on FIGS. 4 and 5, the axis of the rod-like connecting portion 13*a* is disposed substantially horizontally while the heated needle-shaped element 14 is pressed end-wise from above against the respective tubular connecting portion 13*b* for forming the hole 16 and also while the needle-shaped element 14 is withdrawn upwardly so that the fused thermoplastic resin flows, under the influence of gravity, into the part of the hole 16 in the rod-like connecting portion 13*a*.

It will be appreciated that, when the plant organ simulating members 11 and 12 are assembled together at the joints 13 in accordance with the present invention, as described above, the respective plant organ simulating members are securely locked together. Such locking together of the assembled plant organ simulating members is achieved without modifying the molds for forming the same, and without increasing the likelihood that the tubular connecting portions 13*b* will be axially split during the interengagement thereof with the respective rod-like connecting portions 13*a*.

Although the invention has been shown and described applied to an artificial representation of a plant having members 12 representing only foliage or leaves mounted on the stem-simulating member 11, it will be appreciated that some or all of the plant organ simulating members 12 may simulate flowers in addition to, or in place of leaves.

Furthermore, although the rod-like connecting portions 13*a* are shown provided on the stem-simulating member 11 and the tubular connecting portions 13*b* are shown provided on the leaf-simulating members 12, the positions of the connecting portions can be reversed, that is, the rod-like connecting portions 13*a* could be provided on the leaf-simulating members 12 and the tubular connecting portions 13*b* could be provided on the stem-simulating member 11.

Having described a specific embodiment of the invention with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. In an artificial representation of a plant comprising organ simulating members respectively having rod-like and tubular connecting portions molded of thermoplastic resin and being axially interengaged to provide joints for assembling together the respective plant organ simulating member; the improvement of each of said joints having a hole fused through the respective tubular connecting portion and including a portion penetrating into the respective rod-like connecting portion interengaged therewith, the thermoplastic resin removed from said tubular connecting portion in fusing said hole therethrough collecting at least in part in said portion of the hole penetrating into said respective rod-like connecting portion and adhering to the latter for securely locking together the respective plant organ simulating members.

2. An artificial representation of a plant according to claim 1; in which said plant organ simulating members assembled together at each of said joints respectively constitute a stem-simulating member terminating in on of said rod-like and tubular connecting portions and a leaf-simulating member having a petiole-like part terminating in the other of said rod-like and tubular connecting portions.

3. An artificial representation of a plant according to claim 2; in which said stem-simulating member has a plurality of said rod-like connecting portions extending therefrom, and each said leaf-simulating member has one of said tubular connecting portions extending from the respective petiole-like part.

4. An artificial representation of a plant according to claim 3; in which each said leaf-simulating member has a plurality of leaf-like parts branching from said petiole-like part.

5. A method of locking together plant organ simulating members respectively having rod-like and tubular connecting portions molded of thermoplastic resin and being axially interengaged to provide joints for assembling together the respective plant organ simulating members; comprising fusing a region of said tubular connecting portion of each of said joints and at least a part of the respective rod-like connecting portion underlying said region so as to form a hole fused through said region and including a portion penetrating into said respective rod-like connecting portion, and flowing at least some of the thermoplastic resin removed from said tubular connecting portion in fusing said hole therethrough into said portion of said hole in said respective rod-like connecting portion so that the flowed resin, when set, prevents relative turning and axial displacements of the respective rod-like and tubular connecting portions.

6. The method according to claim 5; in which said fusing and flowing are affected by pressing a heated needle-shaped element end-wise against said tubular connecting portion of each said joint with said needle-shaped element extending substantially in a radial direction in respect to the axis of the respective rod-like connecting portion so as to penetrate through said tubular connecting portion and at least partly into said respective rod-like connecting portion, and then withdrawing said heated needle-shaped element in said radial direction to permit the fused thermoplastic resin to cool and set in adhering relation to both said tubular and rod-like connecting portions.

7. The method according to claim 6; in which said axis of the rod-like connecting portion is disposed substantially horizontally while said heated needle-shaped element is pressed end-wise from above against said respective tubular connecting portion to form said hole and while said needle-shaped element is withdrawn upwardly so that the fused thermoplastic resin flows, under the influence of gravity, into said portion of the hole in said respective rod-like connecting portion.

8. The method according to claim 5; in which said plant organ simulating members assembled together at each of said joints respectively constitute a stem-simulating member terminating in one of said rod-like and tubular connecting portions and a leaf-simulating member having a petiole-like part terminating in the other of said rod-like and tubular connecting portions.

9. The method according to claim 8; in which said stem-simulating member has a plurality of said rod-like connecting portions extending therefrom, and each said leaf-simulating member has one of said tubular connecting portions extending from the respective petiole-like part.

10. The method according to claim 9; in which each said leaf-simulating member has a plurality of leaf-like parts branching from said petiole-like part.

* * * * *